United States Patent [19]

Gottwald et al.

[11] Patent Number: 4,698,567

[45] Date of Patent: Oct. 6, 1987

[54] RIBBON DECK MOTOR CONTROL

[75] Inventors: Johannes F. Gottwald, Park Ridge; Dennis W. Gruber, Arlington Heights, both of Ill.

[73] Assignee: Xerox Corporation, Stamford, Conn.

[21] Appl. No.: 818,578

[22] Filed: Dec. 27, 1985

[51] Int. Cl.[4] ..... B41J 33/34

[52] U.S. Cl. ..... 318/480; 318/258; 318/313; 400/212; 400/225

[58] Field of Search ..... 318/257, 258, 259, 260, 318/309, 313, 371, 373, 375, 470, 480; 400/192, 212, 225, 191, 206, 211, 223, 237, 902, 903

[56] References Cited

U.S. PATENT DOCUMENTS

| | | | |
|---|---|---|---|
| 3,657,625 | 4/1972 | Miller et al. | 318/370 |
| 4,570,110 | 2/1986 | Bloom et al. | 318/313 |

FOREIGN PATENT DOCUMENTS

| | | | |
|---|---|---|---|
| 0038290 | 10/1981 | European Pat. Off. | 400/225 |
| 58-58885 | 4/1983 | Japan | 318/313 |
| 7608038 | 2/1977 | Netherlands | 400/225 |

*Primary Examiner*—William M. Shoop, Jr.
*Assistant Examiner*—Bentsu Ro
*Attorney, Agent, or Firm*—Robert E. Cunha

[57] ABSTRACT

Apparatus for adapting a common dc motor for use in a typewriter to drive the ribbon lift and advance functions. The motor is coupled by means of a set of gears to a shaft on which are mounted the ribbon advance gear and ribbon lift cams. Also mounted on the shaft is a slotted disk. As the motor and disk rotate, an optical sensor outputs a signal for each slot. A processor then computes the motor speed from the slot timing and issues modulated pulses to the motor to regulate its speed.

2 Claims, 12 Drawing Figures

| DKTBL ACC VALUE | OFF TIME (FROM TABLE) | ON TIME = 30 - OFFTIME | T SLOT |
|---|---|---|---|
| 0 | 30 | 0 | 0 - 2.0 ms |
| 1 | 28 | 2 | 2.1 - 2.3 ms |
| 2 | 26 | 4 | 2.3 - 2.4 ms |
| 3 | 24 | 6 | 2.5 - 2.6 ms |
| 4 | 22 | 8 | 2.7 - 2.8 ms |
| 5 | 20 | 10 | 2.9 - 3.0 ms |
| 6 | 18 | 12 | 3.1 - 3.2 ms |
| 7 | 16 | 14 | 3.3 - 3.4 ms |
| 8 | 14 | 16 | 3.5 - 3.6 ms |
| 9 | 12 | 18 | 3.7 - 3.8 ms |
| 10 | 10 | 20 | 3.9 - 4.0 ms |
| 11 | 8 | 22 | 4.1 - 4.2 ms |
| 12 | 6 | 24 | 4.3 - 4.4 ms |
| 13 | 4 | 26 | 4.5 - 4.6 ms |
| 14 | 2 | 28 | 4.7 - 4.8 ms |
| 15 | 1 | 29 | 4.9 ms & UP |

*FIG. 8C*

RIBBON DECK MOTOR CONTROL

BACKGROUND OF THE INVENTION

This invention is a mechanism and associated circuitry which allows the use of a low-cost dc motor to be used in an electronic typewriter to drive the ribbon advance and ribbon lift functions, and more specifically, comprises a timing disk and microprocessor controlled motor driver to accurately control the dc motor.

In basic electronic typewriters, the lowest cost components must be used to drive the various moving parts which include the ribbon advance and ribbon lift. Solenoids and stepping motors in conjunction with various cam-driven mechanisms have been used because a stepping motor torque, speed and angular position are easily controlled, but a stepping motor and its drive circuit are a relatively expensive solution to the problem in a low-cost typewriter. Specifically designed dc motors with clutches and lift solenoids have also been used, but the cost of these components is relatively high. In all cases the goal is to use the lowest cost parts to achieve reliable operation.

Direct current motors such as are used in household hair dryers and can openers are manufactured in numbers exceeding a hundred million per year, and as a result of the continuing engineering applied to these motors, can be specified and purchased in a range of reliability, speed and power at very low cost. The drive circuit for a dc motor is also very simple since the motor has commutator rings that allow it to be driven from a simple dc source. The disadvantage of a motor of this type is that there is normally very little control over the speed and torque of the motor. In its normal use, a voltage is applied, and the motor will spin up to its terminal speed which is quite variable depending on voltage fluctuations, load and individual motor characteristics. This lack of speed control would be a large disadvantage in a typewriter where the operator needs a constant and predictable action from the typewriter in response to the key strokes to establish a comfortable rhythym.

What is required is a low cost circuit, motor and associated mechanism for controlling the ribbon advance and ribbon lift in an electronic typewriter.

SUMMARY OF THE INVENTION

This invention is a system comprising mechanical and electrical components which control a dc motor to drive through a predetermined fraction of a revolution at a predetermined and regulated rate. The motor is mechanically coupled to a slotted disk which in turn is monitored by a light emitter and light sensor for detecting the passage of the slots. The system microprocessor receives the light sensor output, measures the time between the detection of the slots, and uses that time in a look up table to determine the speed of the motor. In the alternative, an algorithm may be used. In either case, the microprocessor uses this information to calculate the pulse modulation required to correct the motor speed. The microprocessor also calculates the disk position by counting the slots, and stops the motor when it reaches the next home position.

The sensor assembly comprises a light emitting diode and a light sensitive transistor mounted in a package. These units are common in the commercial market. The disk is made of any convenient material such as metal or plastic. The only requirements are opacity to light and mechanical strength. The motor driver is also a commercial package containing a circuit designed to drive a dc motor with a supply voltage of 32 volts. Finally, the microprocessor is not only commercially produced, but can be shared in the typewriter with other functions such as control of the daisy wheel, keyboard and communication link. The result is a control apparatus which allows the use of a low cost dc motor in place of a more common stepping motor to drive the ribbon advance and lift functions.

This invention will be more readily understood in relation to the following drawings.

Figure 4A:
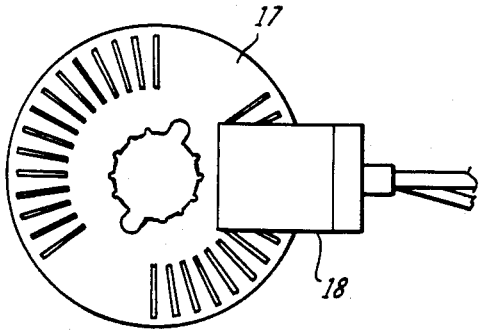

FIG. 4*a* is an axial view showing the relative position of the disk and sensor.

Figure 4B:
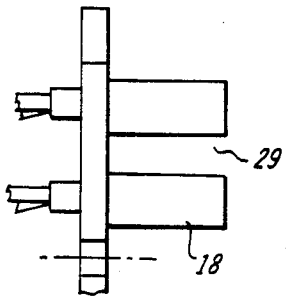

FIG. 4*b* is a side view of the sensor assembly.

Figure 4C:
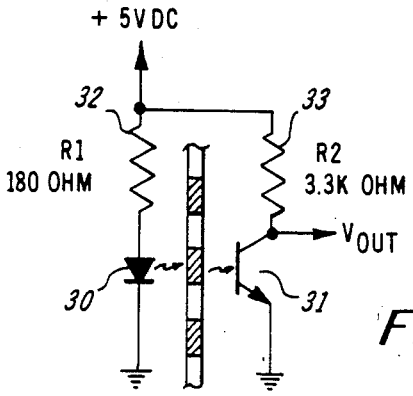

FIG. 4*c* is a schematic diagram of the sensor circuit.

Figure 5:
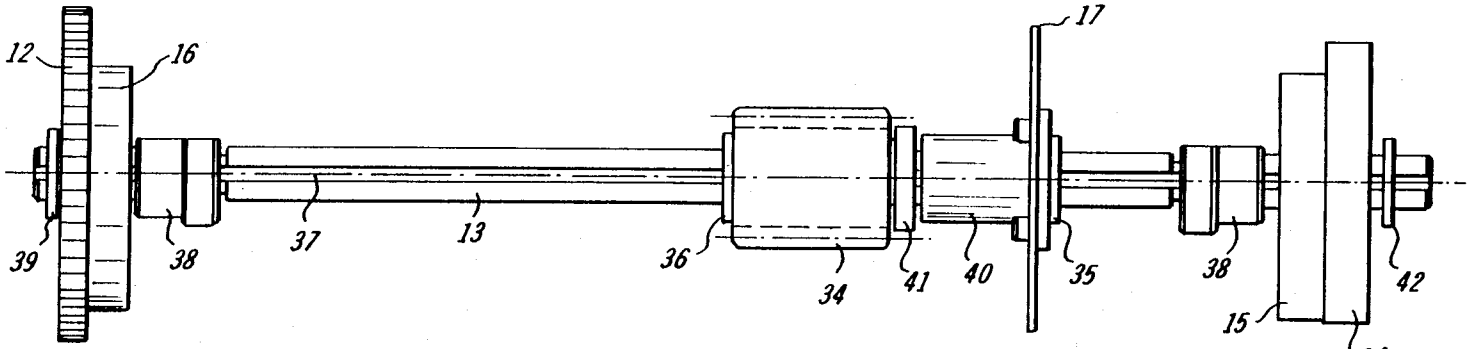

FIG. 5 is a front view of the main shift and the elements mounted thereon.

Figure 6:
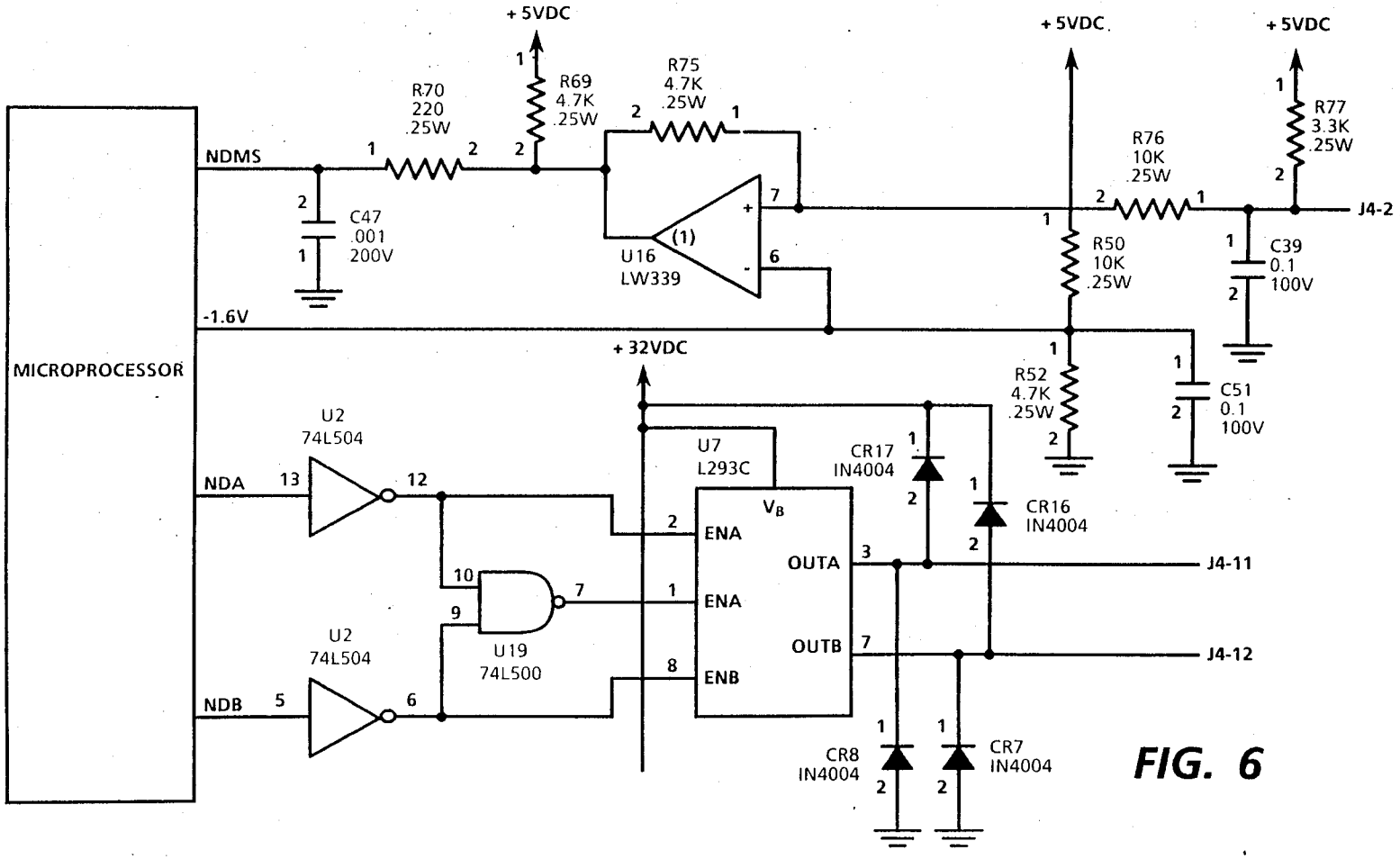
Figure 7:
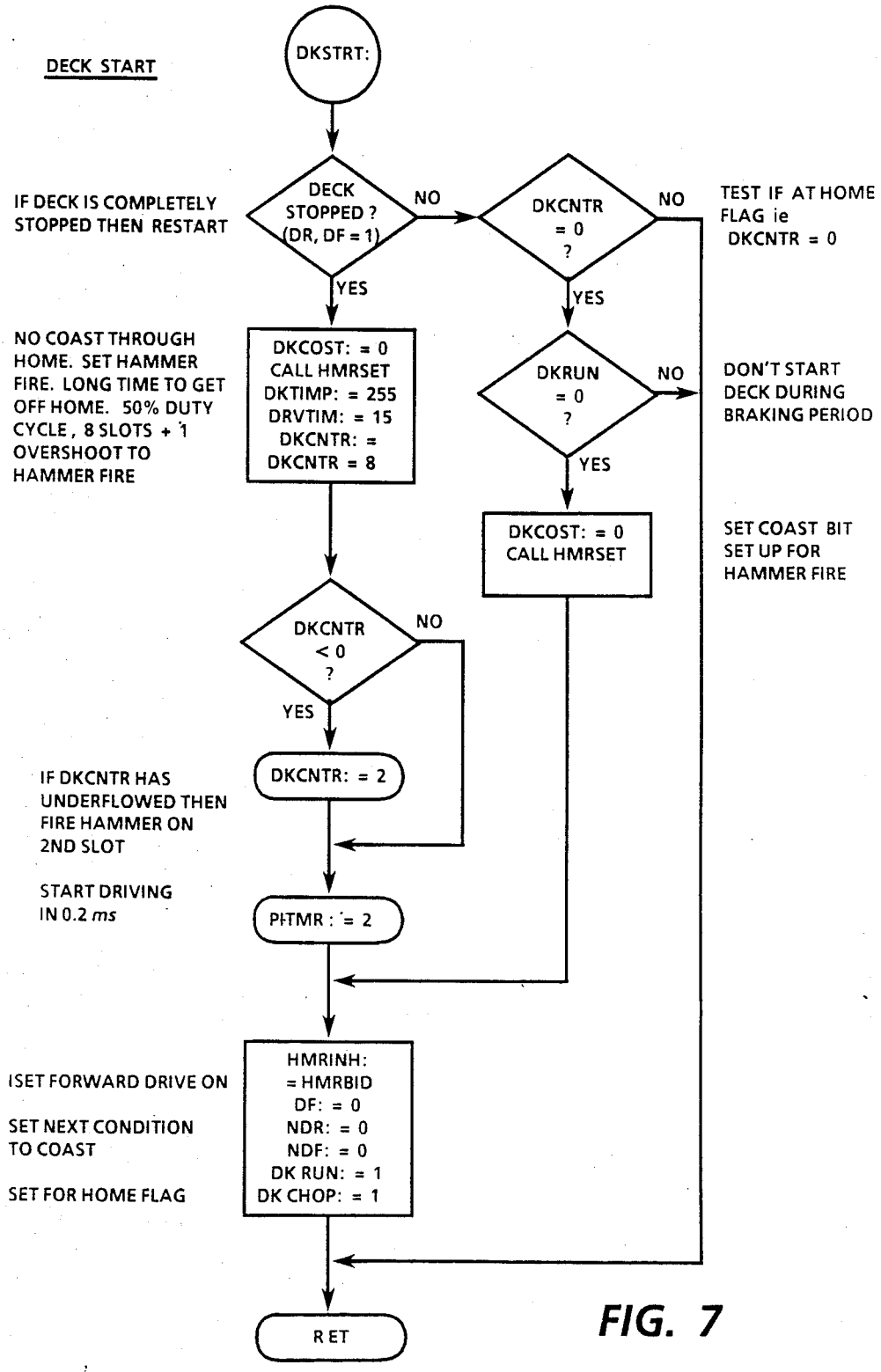
Figure 8A:
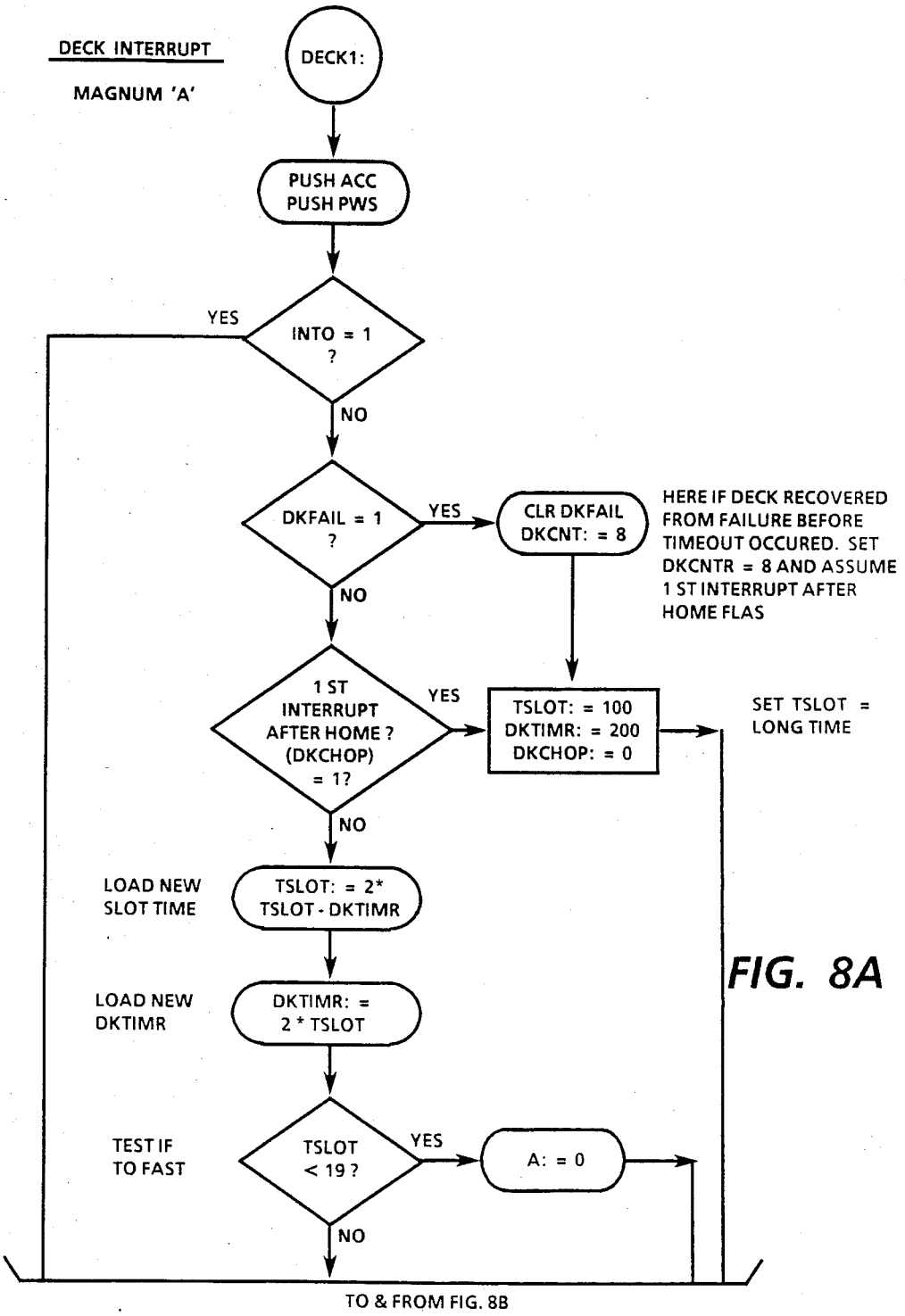
Figure 8B:
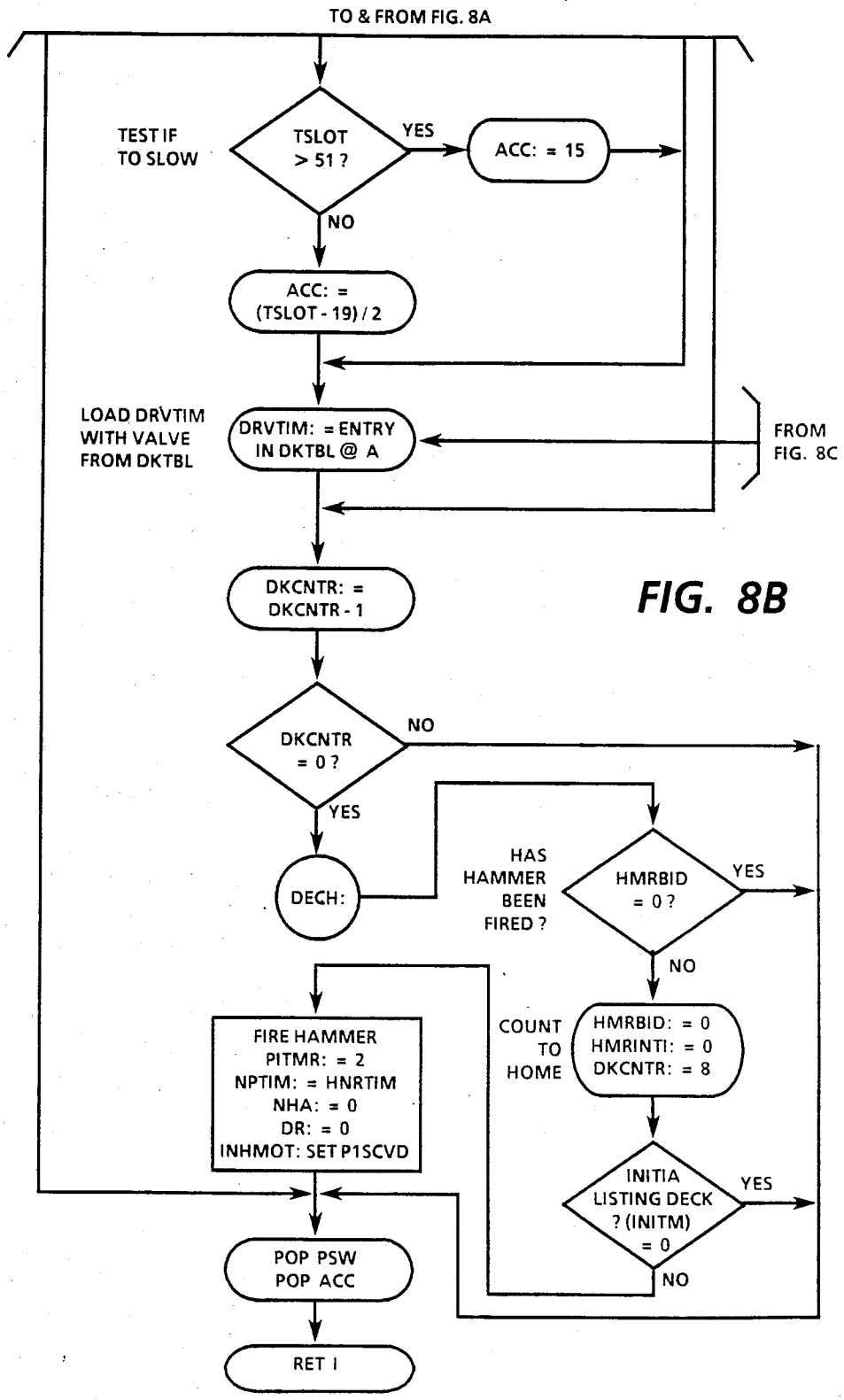

FIG. 6 is a schematic diagram of the driver circuit.

FIGS. 7, 8, 9 and 10 are flow charts which describe the operation of the system.

DETAILED DESCRIPTION OF THE INVENTION

Figure 1:
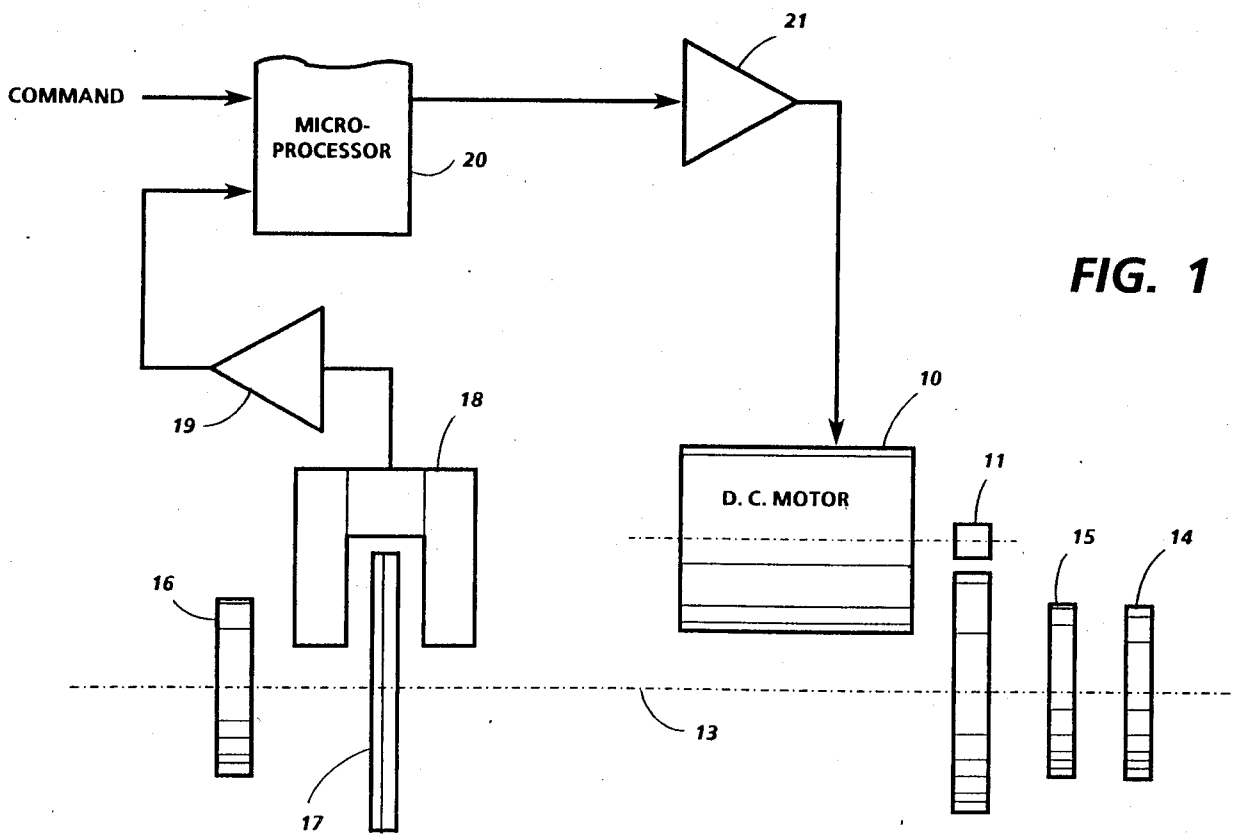
FIG. 1 is a simplified control system diagram.

FIG. 1 is a simplified diagram of the system. The dc motor 10 is geared down through gears 11, 12 to drive the shaft 13. The gears reduce the shaft 13 rotation rate by an approximate factor of five. Mounted on the shaft are two print ribbon lift cams 14, 16 and an erase ribbon lift cam 15. The cams are designed so that there will be two print ribbon lift cycles per shaft rotation, but only one erase cycle per rotation. This is because the print ribbon is two characters high, with the lower portion being used for one character and the upper portion used for the next, while the erase ribbon is only one character high. Therefore, the erase cycle comprises the rotation of the disk until the erase ribbon is positioned correctly before the character is erased.

There is also mounted on the shaft 13 a disk 17 in which slots are cut. As the disk 17 rotates, the light sensor assembly 18 senses the passage of the slots. The sensor 18 output goes to a comparator 19 which differentiates between the sensor high and low outputs.

The microprocessor 20 receives the comparator 19 output and determines the speed of the disk, and therefore the motor, by measuring the time between comparator 19 outputs. Based on a comparison between the desired and actual speeds, the microprocessor will issue a pulse width modulated signal to the driver 21 which adjusts the speed of the motor 10.

It can now be seen that the cost of the system has been kept low in that all of the electronic parts are off-the-shelf commercial parts, and that the only unusual mechanical part required for the apparatus is a simple plastic or metal disk 17.

Figure 2:
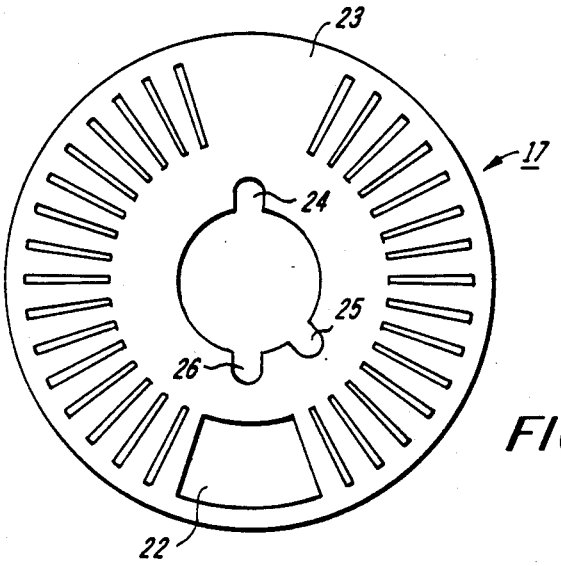
FIG. 2 is a front view of the disk.

FIG. 2 is a detailed drawing of the disk 17. The body of the disk in the described embodiment is made of berylium - copper, but any opaque metal or plastic material would be equally useful for this application. There are two home, or rest, positions, one "light" home position defined by the wide window 22 and one "dark" home position defined by the general area around point 23. Each half of the disk has sixteen slots, if the wide window 22 is counted as one of the slots on the right half of the disk. In this embodiment, each narrow slot is two degrees wide, the wide slot is about forty degrees wide, and the angle between the leading edges of adjacent slots is about nine degrees. Three keys 24, 25, 26, located non-symmetrically, ensure that the disk will be mounted on the shaft correctly. The disk has a diamter of about one inch and is approximately five thousandths of an inch thick.

Figure 3:
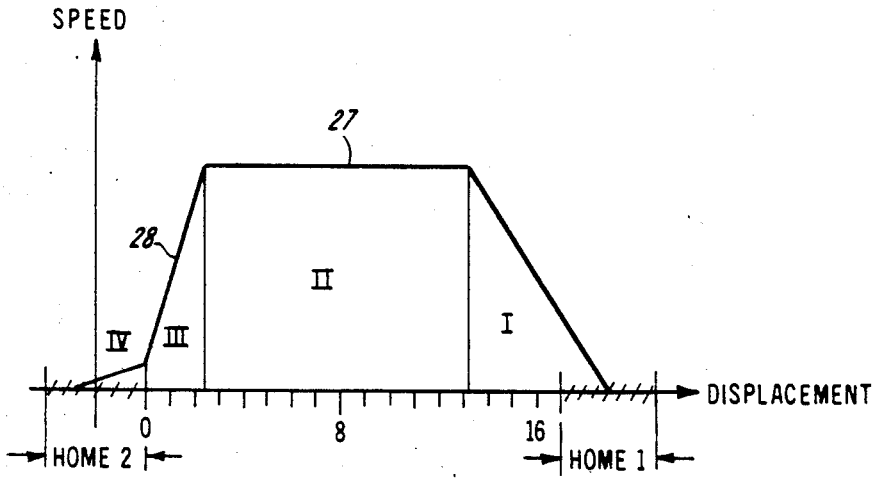
FIG. 3 is phase plane diagram of the speed and displacement of the motor through one half of a rotation.

FIG. 3 is a phase plane diagram of the motor control system, plotting shaft speed against displacement. For a representative cycle of operation, assume that the motor is starting a cycle at the center of the area at the right end of the graph marked Home 1, and is proceeding to the left. Initially, for the duration of the displacement segment marked I, full power is applied to the motor, driving the motor speed to some predetermined value, which is well below the full rated speed of the motor. This speed is chosen so that the motor will always be able to operate at the same rate, regardless of the age of the components, power fluctuations, etc., so that the operator can become accustomed to the rhythym of the typewriter. The duration of this first segment can be either the time required for the motor to go through a predetermined number of slots, or a predetermined time.

The system then enters segment II where a predetermined rate speed will be held. This speed is shown as line 27 and approximates 2 milliseconds per slot. It is to be expected that after a predetermined time period or a predetermined number of slots have been passed in segment I, that the motor speed will not be exactly equal to the desired speed as shown as line 27. To correct for this difference, the speed of the disk, as measured by the elapsed time between slot edges, is compared against a reference to calculate a difference. The processor then pulsewidth modulates the output to the motor to correct the speed. When the correct speed is achieved, the processor continues to monitor the speed to maintain it at the predetermined level.

During segments I and II the processor counts disk slots. At a predetermined number, the system enters segment III where the system slows the motor as the Home 2 position is approached. The slowing of the motor is shown by the declining line 28. The actual slowing of the motor is accomplished by applying reverse voltage to the motor. Finally, at the start of segment IV the motor is put into a dynamic braking mode by shorting the windings, finally stopping the motor in the Home 2 position. The next rotation from the Home 2 to Home 1 positions is accomplished in the same way.

When the typewriter is first turned on, the system can be initialized by driving the disk forward at a fixed speed until one of the two wide slots is detected. Then the motor is stopped by using reverse current and dynamic braking, as described above in segments III and IV.

FIG. 4A is a front view of the disk 17 and sensor assembly 18, showing their relative positions. FIG. 4B is a side view of the sensor assembly 18 and shows the slot 29 in which the disk is positioned. FIG. 4C is the sensor circuit which is contained in a commercial package and is sold as part number HOA-1881. The light emitting diode 30 is continuously driven by the five volt supply through the 180 ohm resistor 32. The light sensitive transistor 31 is connected to the positive five volt input through 3.3 K ohm resistor 33. When the light is blocked completely the sensor output should be +4.7 volts minimum with a +5 volt input, and should have maximum current of 0.1 ma.

In actual use, even when the sensor assembly is positioned directly between disk slots, there is some leakage of ambient light into the sensor as well as some light which leaks through the slots. In this case the output should be a minimum of four volts at a maximum current of 0.3 ma. With the sensor assembly centered on a slot, the output should be 0.6 volts maximum. These figures assume a disk rotation of 750 rpm, which makes the test more stringent since the output voltage tends to ramp up and down at a finite rate due to the limited response time of the phototransistor 31.

The arrangement of the various elements that are mounted on the main shaft 13 are shown in FIG. 5. Two bearings 38 support the shaft, which has a slot 37 into which all of the remaining elements are fitted. At the left end there is a gear 12 which couples the shaft to the dc motor, and the left ribbon lift cam 16, both held in place by retaining ring 39. Toward the center of the shaft there is the disk 17, a hub 40 on which the disk is mounted, a washer 41 and a worm gear 34 which drives the ribbon advance, all of which are held in place by two retaining rings 35, 36. On the right end of the shaft 13 are mounted the erase ribbon lift cam 15 and the right ribbon lift cam 14, held in place by another retaining ring 42.

The circuits which couple the microprocessor, the sensor assembly and the dc motor are shown in FIG. 6. The signal from the sensor is received at pin J4-2 and is coupled to the input of comparator U16, part number LM339. The positive feedback resistor R75 provides the circuit with enough hysteresis to filter out some of the random variations in the input line. The comparison voltage of 1.6 volts is generated from the five volt supply by the voltage divider comprising resistors R52 and R50, and is filtered by capacitor C51. The input line is filtered by capacitor C39, and also contains the 3.3K resistor R77 which is shown as the phototransistor collector resistance R2 in FIG. 4C. The output signal NDMS is connected to the microprocessor, which in this described embodiment can either be a part number 8031 or 8051 microprocessor.

The main element in the motor drive circuit is device U7, part number L293C which has a tri-state output. That is, the output at each output line J4-11 or J4-12 can either be high, low or open-circuited. When the NDA and NDB inputs are respectively 0 and 1, the outputs at pins 3 and 7 of the driver U7 are high at line J4-11 and low at line J4-12, which drives the motor in a forward direction. Inputs of 1 and 0 result in a reverse output. An input of 1, 1 results in both outputs going high which effectively shorts both lines directly to ground, thereby dynamically braking the motor. Finally, an input of 0, 0 results in both output lines opening, allowing the motor to coast. Referring back to FIG. 3, in segment I the motor will be turned on all the time where one input line is continuously high and the other low, in segment II while being pulse modulated the motor will be alternately turned on or allowed to coast with both input lines open, in segment III the motor will receive continuous reverse voltage, and in segment IV it will be dynamically braked, meaning that both lines will be tied to ground. The four snubbing diodes, CR7, CR8, CR16 and CR17 conduct dc motor current surges to the power supply or to ground.

The following is an overall description of the carriage mechanism assembly in which the invention is used.

The DC motor is used to drive the ribbon lift, ribbon advance, correcting tape lift and correcting tape advance. This motor has a gear pinion to a gear on the main shaft. The ink ribbon advance is accomplished by a spur gear engaged with the takeup side of the ribbon cartridge. The spur is driven via a gear train whose input is from the main shaft.

Both ink and corrector ribbons are lifted through mechanical linkages that follow cams on the main shaft. The corrector tape advance is accomplished by an escapement pawl that operates when the tape is lifted and raised. The selection of corrector tape is done mechanically via a trip magnet. Rotational feedback is accomplished via a photosensor and slotted disk that interrupts the light source to the photosensor. The slotted disk also is located on the main shaft.

For each print cycle the dc motor is energized via electronic circuitry that is controlled by a microprocessor. The motor is driven until the main shaft has completed 180 degrees of rotation. The speed of the motor and the length of drive time to get 180 degrees rotation is controlled by the microprocessor through its monitoring of the signals from the photosensor output. During the 180 degree rotation the cams drive up the ribbons to the print position and advance the ribbon. Timing for when to fire the hammer so that it impacts the ribbon in its raised position is also determined by the microprocessor via signals from the sensor.

The drive circuit has two inputs from the microprocessor and two outputs which tie to the two sides of the motor armature. With the two inputs the current to the motor can be driven bi-directionally, turned off (coast) or shorted (brake).

The interrupter disk has two areas of slotted openings and an area of no slots to coincide with the lobes of the cams on the main shaft. The wide unslotted areas serve to locate the stop position of the main shaft i.e., when the ribbons are in the rest or down position. The multi-slotted areas provide feedback for determining rotational position and velocity.

The two areas of the disk without slots are additionally distinguished from one another in that one is an open area allowing light to pass and the other is a solid area which blocks the light. This is done so that the position of the erase cam can be detected. This is necessary because the erase cam only cycles once per revolution of the main shaft and must be in the proper position for activation of the trip magnet at the beginning of an erase cycle.

The output from the sensor is tied to the microprocessor interrupt pin. At each interrupt a timer (TSLOT) is loaded with the time between the current and the previous interrupt from the sensor. This time is then used to calculate a duty cycle for driving the motor for the next interval. In addition, another timer (DKTIMR) is loaded with twice the current measured time between slots. This DKTIMR is then used to detect a 2 to 1 change in time between slots which allows detection of the home position on the feed back disk. Since this timer measures for a 2 to 1 change versus an absolute value, the home detection is fairly insensitive to motor speed variations.

Another register (DKCNTR) is used to count the slot interrupts to determine when to fire the hammer. A particular slot count represents the point in the cycle where the ribbins are in their fully lifted position. Prior to starting a deck cycle the deck slot count register is loaded with a value equal to the number of slots to the print position. When this register counts down to zero the hammer is fired and the register is reloaded with the number of slots to reach the next stop position. The purpose of reloading this register is so that the stop position can be anticipated. By anticipating the stop position, stopping on the home flag can be eliminated in cases where the other positioning operations are near completion. This reduces the power that would be put into the system stopping and restarting the motor motion.

In order to protect the motor, in case of a jammed mechanism, the deck is stopped if the home condition is detected prior to hammer fire and an error condition bit is set.

The ratio of drive to coast was determined empirically, limitations on this ratio were ensuring enough velocity to achieve desired printing speed, and matching the deck cycle to the other printing elements in order to increase frequency of coasting through home thereby reducing power consumption and heat buildup in the motor.

The frequency for chopping was determined empirically. The factors that controlled this time were that the time had to be long enough to reduce the processing time required each time it needed to switch from coast to drive states, and that the time needed to be kept short enough to be responsive to changes in speed due to varying load during each cam cycle.

Several problems had to be overcome. If the stop position is overrun there is the potential for firing the hammer at the wrong position. This was solved by allowing the slot counter to overrun resulting in a negative value. This negative value is then added to the count to hammer fire value thereby compensating for the overrun in the next cycle.

If the operator manually turns the main shaft, the overrun could be greater than the total steps to hammer fire. This would result in a very large count to hammer fire. If this should occur the count is set to a fixed value to eliminate excessive cycles of the mechanism before re-synchronizing i.e., looking for the home flag again.

Since the mechanism stops in the unslotted area of the disk and a relatively long time elapses from initial DECK ON to the first slot; to prevent this long time from invoking the stop routine (DKTMR going to zero); DKTIMR is initially loaded with a large value.

As a result of coasting through the home position during successive print cycles another precaution that had to be made was to defeat the speed regulation routine so that excessive power was not put into the system because of the long time between slots. This was accomplished by setting a bit to indicate this mode. This bit is set at the beginning of a deck cycle and cleared on the first deck sensor interrupt. When the deck sensor interrupt occurs with this bit set the TSLOT AND DKTIMR registers are preset and no duty cycle calculations are performed.

DEFINITION OF TERMS

FLAGS:

DKRUN—Flag indicating the DecK is RUNning (1) or stopped (0).

This flag is set on when in the deckstart routine and cleared in the timer interrupt routine when the home flag is detected.

DKFAIL—Flag indicating a DecK FAILure has occurred. This flag is set in the timer interrupt routine when DKTIMR has been decremented to zero (normally a home detect condition) and the hammer has yet to be fired. This flag is cleared in the deck interrupt routine when a sensor interrupt occurs.

DKCOST—Flag indicating the DecK is to COaST through the home flag. This flag when set indicates the carriage and printwheel positioning has been completed sufficiently that the deck need not stop at the next home position.

DKCHOP—Flag indicating a DecK CHOPping is being performed at a default duty cycle in order to get through or off the home flag. This flag is set in the timer interrupt routine when the home flag is detected or in the deck start routine when the deck is started from a stopped condition.

This flag is cleared in the deck interrupt routine when the first interrupt occurs. The purpose of the flag is to indicate to the deck interrupt routine that this is the first interrupt after the home position and therefore DKTIMR and TSLOT cannot be used to compute duty cycles in the normal manner but they must be initialized for normal computation in subsequent interrupts.

ERSCAM—EraSe CAM position flag. This flag is set and cleared in the timer interrupt routine when the home flag is detected to indicate the position of the erase cam.

HMRBID—HaMmeR BID flag indicates the hammer is to be fired. This flag is used to indicate the deck is in the front end of a cycle, i.e. the hammer has not yet been fired, versus the tail end of a cycle after the hammer has been fired and the deck is moving to the next home flag.

HMRINH—HaMmeR INHibit flag - used to inhibit motion of printwheel and carriage prior to hammer fire.

INITM—Flag indication that the INITalize Mechanism is being performed. This flag is used in the deck interrupt routine in lieu of a HMRBID flag during the initializing of the deck.

P1SVCD—Port 1 SerViCed flag - this flag indicates the next I/O condition and time for that condition is ready for the timer interrupt routine to process.

DF—Deck Forward drive I/O pin

DR—Deck Reverse drive I/O pin

HA—HAmmer control I/O pin

NDR—Next Drive Reverse I/O pin condition

NDF—Next Drive Forward I/O pin condition

REGISTERS

P1TMR—Port 1 TiMeR - timer to control the duration of events on its port one. Port 1 is the I/O port which contains the pins which control the circuitry for the hammer and deck motor. P1TMR is decremented every .1ms. When the timer interrupt routine decrements this register to zero it tests the P1SVCD bit to determine if a new time and event is ready to be set on the I/O port. If so the value in NXP1 is set on the I/O port and P1TMR is loaded with the value in NXPTIM and the P1SVCD flag is cleared.

DKTIMR—DecK TIMeR - Timer used to time events of the deck interrupt.

HMRTIM—HaMmeR TIMer - Register to hold the duration of the hammer pulse. Its value is transferred to the P1TMR when the hammer is fired.

TSLOT—Time of last SLOT interval - This register contains the time of the previous slot interval. Its value is multiplied by two and placed into DKTMR at each deck interrupt. A new TSLOT is computed at each interrupt by subtracting the remainder of the DKTMR from 2xTslot from the previous cycle.

DRVTIM—DRiVe TIMe control register - This register contains the 'OFF' or coast duration for chopping the motor drive. The value in this register is loaded directly into P1TMR in the timer interrupt routine to set a coast time interval or it is subtracted from 30 (3.0 Ms) and the result is loaded into P1TMR to set a drive time interval. The value in DRVTIM is loaded in the deck interrupt routine. The value is extracted from a lookup table based on the time between the previous deck interrupts.

NXP1—NeXt Port 1 state to be set on the I/O pins of port 1 when the current condition is timed out.

NPTIM—Next Port 1 TIMe interval - This register contains the time desired for the NXP1 state to remain on the P1 I/O port pins.

DETAILED DESCRIPTION OF THE FLOW CHART is contained in FIGS. 7 through 10.

DECK START ROUTINE: (FIG. 7)

The deck start routine is called when the printwheel and carriage have been positioned close enough that the deck can be started and they will be completely settled at the time of hammer impact.

When called, the deck start routine must test to determine if the deck is stopped, near the home flag or still moving with a number of slots to go to reach the next home flag.

The first decision is to test for the stopped condition. This is done by testing for either of the drive lines to be active (DF or DR). DKRUN is not used here because the flag is cleared at the time of detecting the home flag in the timer interrupt routine and therefore the braking could be taking place.

IF DECK IS STOPPED:

1. If the deck is stopped then the HMRTIM register is loaded with the proper "hammer" on duration.
2. DKTIMR is loaded with its maximum value to prevent it from decrementing to zero before the first timer interrupt occurs while getting off the home flag.
3. DRVTIM is loaded with a nominal value to provide chopping to the motor while moving to the first slot on the disk.
4. DKCNTR is loaded with the number of slots to the hammer fire position. This is done by adding 8 to the current value of DKCNTR (which is typically 0).
5. The result in DKCNTR is tested to determine if it is negative.

IF DKCNTR NEGATIVE:

If DKCNTR result is negative either from a malfunction or manual intervention, it is set with a value of 2 which will result in hammer fire after 2 slot interrupts and then home will be looked for.

IF DKCNTR NOT NEGATIVE:

If DKCNTR is positive then P1TMR is loaded with a small number (2) such that in a short period of time (0.2 ms) the timer interrupt will decrement it to zero and test for the next event and time to be output on its port 1 I/O pins.

FUNCTION IN STARTING THE DECK

The final operations in starting the deck, whether it was stopped or it is to coast through the home flag are:

1. Set HMRINH=HMRBID−HMRINH flag is set if the hammer is to be fired in order to prevent carriage or printwheel motion up to the time of hammer fire.
2. DF is set=0 i.e. the deck forward drive pin is set active 'on'.
3. NDR & NDF are set to the coast condition.
4. DKRUN is set 1 indicating the deck has been started.

5. DKCHOP is set 1 to indicate to the deck interrupt routine that when interrupted the elapsed time is due to moving from the home flag and normal DRVTIM calculations cannot be performed.

IF DECK NOT STOPPED FROM PREVIOUS CYCLE

If the deck has not stopped from the previous cycle the DKCNTR is tested for zero to determine if the deck has been interrupted for the last count.

IF DKCNTR NOT ZERO

If the counter is not zero the deck start routine is exited and will be recalled again.

IF DKCNTR IS ZERO

If the counter is zero then the deck should be entering the home position. At this point the DKRUN flag is tested to determine if braking has already started, in which case it is too late to attempt a coast through the home flag.

IF DKRUN IS NOT SET

If DKRUN is not set the deck start routine will be exited and will be recalled again.

IF DKRUN IS SET

1. If DKRUN is set then the braking has not started and a coast through home operation will flagged for the timer interrupt by setting DKCOST.
2. THE LAST FUNCTION is then performed in the deck start routine.

DECK INTERRUPT ROUTINE: (FIG. 8)

The deck interrupt routine is invoked at each negative edge of the deck sensor. The first test checks that the interrupt was truly from the sensor and not a noise hit. If a noise hit, the routine is exited with no action. If from the sensor the flow will continue with the first test which test is if a deck failure has occurred.

IF DKFAIL

If a failure was detected (in the timer interrupt routine) the deck interrupt routine will clear DKFAIL indicating motion has occurerd and then reset the DKCNTR=8 i.e. assumes the interrupt is first one after the home flag.

DECK5: Then TSLOT and DKTIMR are initialized in order to allow speed calculations to be performred on subsequent interrupts.

DKCHOP is cleared to indicate speed calculations can be performed on the next deck interrupt

GOTO DECK6:

IF NOT DKFAIL:

If no deck failure DKCHOP is tested to determine if speed calculations can be performed.

IF DKCHOP:

If DKCHOP then speed calculations are not possible because the elapsed time was due to getting off or over the home flag.

GOTO DECK5:

IF NOT DKCHOP:

If not DKCHOP then a speed calculation will be performed and a new DRVTIM will be set based on the calculation. This is performed in the following manner:

A. The time between this slot and the previous slot is calculated by subtracting the initial value of DKTIMR from the remainder of DKTIMR. The result time is then placed in TSLOT.
B. DKTIMR is then set equal to two times the new TSLOT.
C. The new slot time is then tested for being in the controlled speed range (in this case from 1.9 to 5.1 milliseconds).
D. If the slot time is out of range, either maximum or minimum duty cycle will be forced by setting the result in the accumulator equal the appropriate end location in the lookup table to be described next.
E. The adjusted accumulator value either scaled or preset from the above calculations is used as an index to a table of values.

DECK6

At this point in the deck interrupt routine the DKCNTR is decremented and tested for zero to determine if it is the appropriate time to fire the hammer.

IF DKCNTR NOT ZERO

If the counter is not zero the routine is exited with no further action.

IF DKCNTR ZERO

If the counter goes to zero the HMRBID flag is tested to determine if the hammer is to be fired or the counter is zero as a result of approaching the stopping position.

IF HMRBID IS NOT SET

If not set the routine is exited with no further action. Normal home detection in the timer interrupt routine should follow.

IF HMRBID IS SET

If set the HMRBID flag will be cleared, the HMRINH flag will be cleared and the DKCNTR will be reset to 8.

At this point it is established that the hammer can be fired. The last decision in the deck interrupt is to test if the deck cycle has been invoked in order to initialize.

IF INTIM is set the routine will be exited without firing the hammer.

IF INTIM is not set:

1. P1TMR is set to 2 (0.2 ms) in order that the timer interrupt routine will soon test for the next event.
2. NPTIM is set=HMRTIM i.e. the desired duration of the hammer pulse.
3. NHA is set on (low) i.e. the next port 1 output will be a hammer on condition.
4. DR is set low i.e. the coast condition is forced during the hammer fire duration.
5. The timers controlling printwheel and carriage motion are set such that no motion of the carriage can occur until hammer impact and no motion of the printwheel can occur until the hammer rebounds out of the way of the printwheel spokes.
6. The P1SVCD flag is then set to flag the timer interrupt routine that the next port 1 output time and condition are valid for presentation to the I/O pins.
7. The deck interrupt routine is now exited.

Figure 9A:
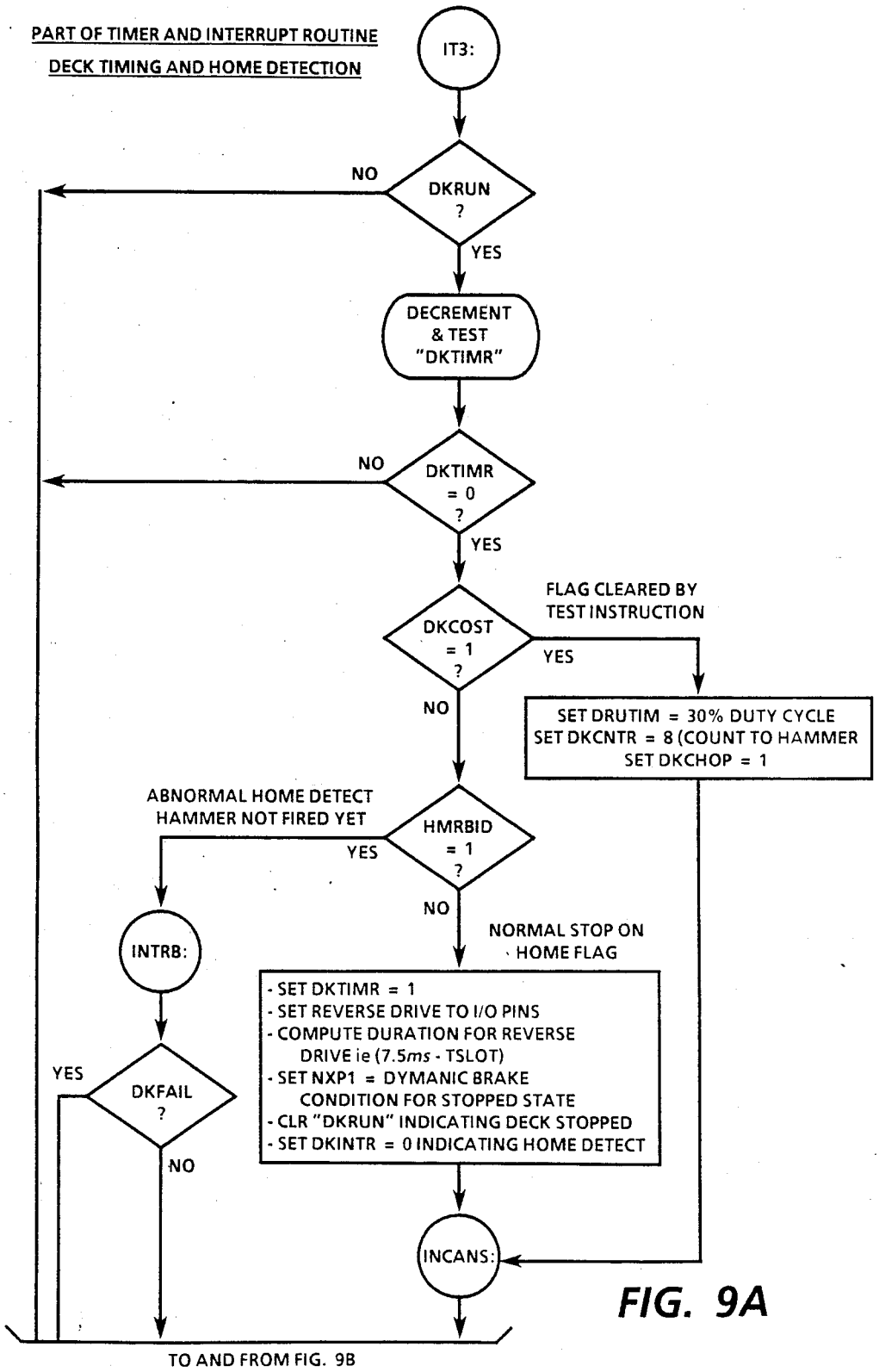
Figure 9B:
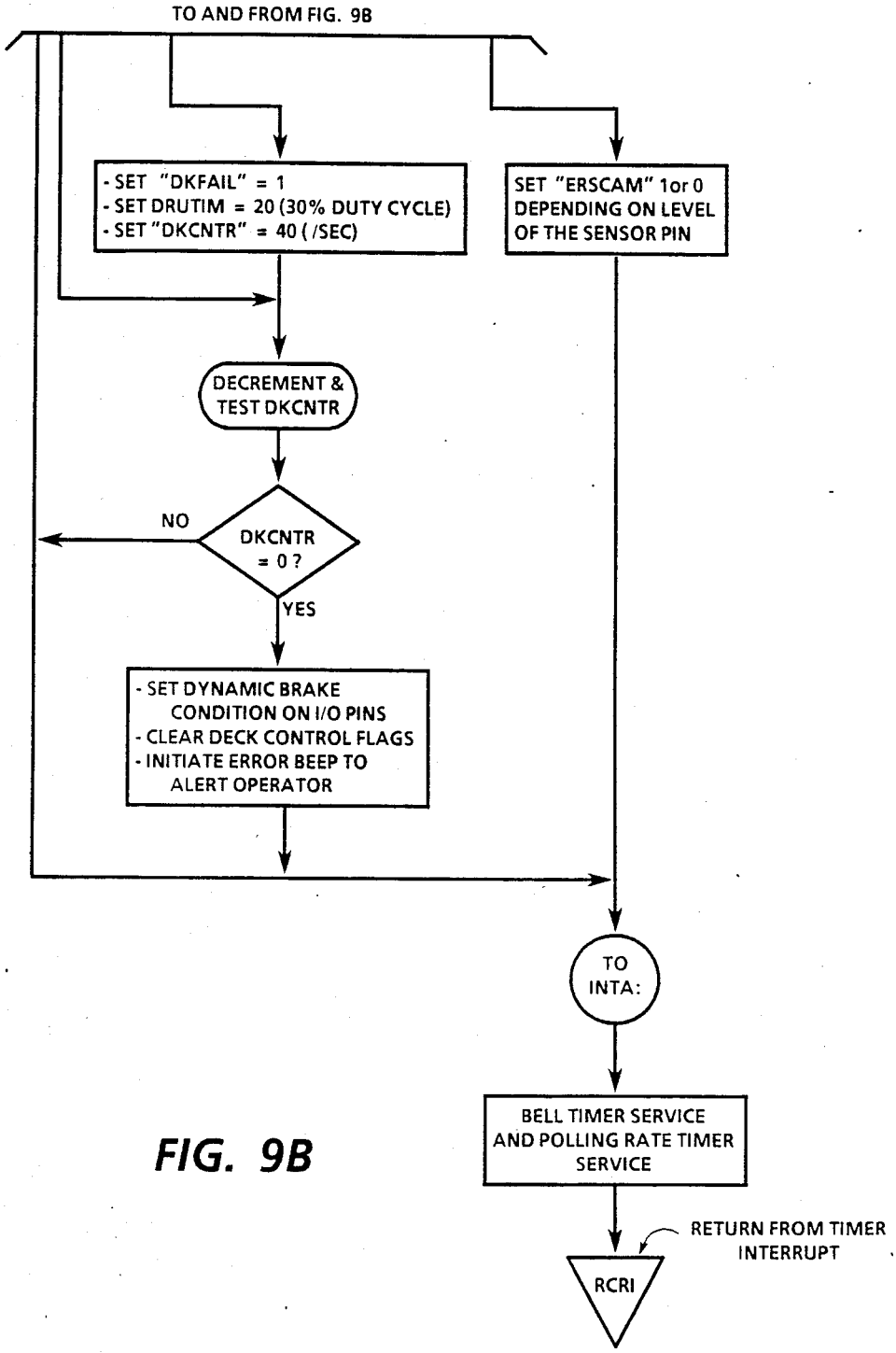
Figure 10A:
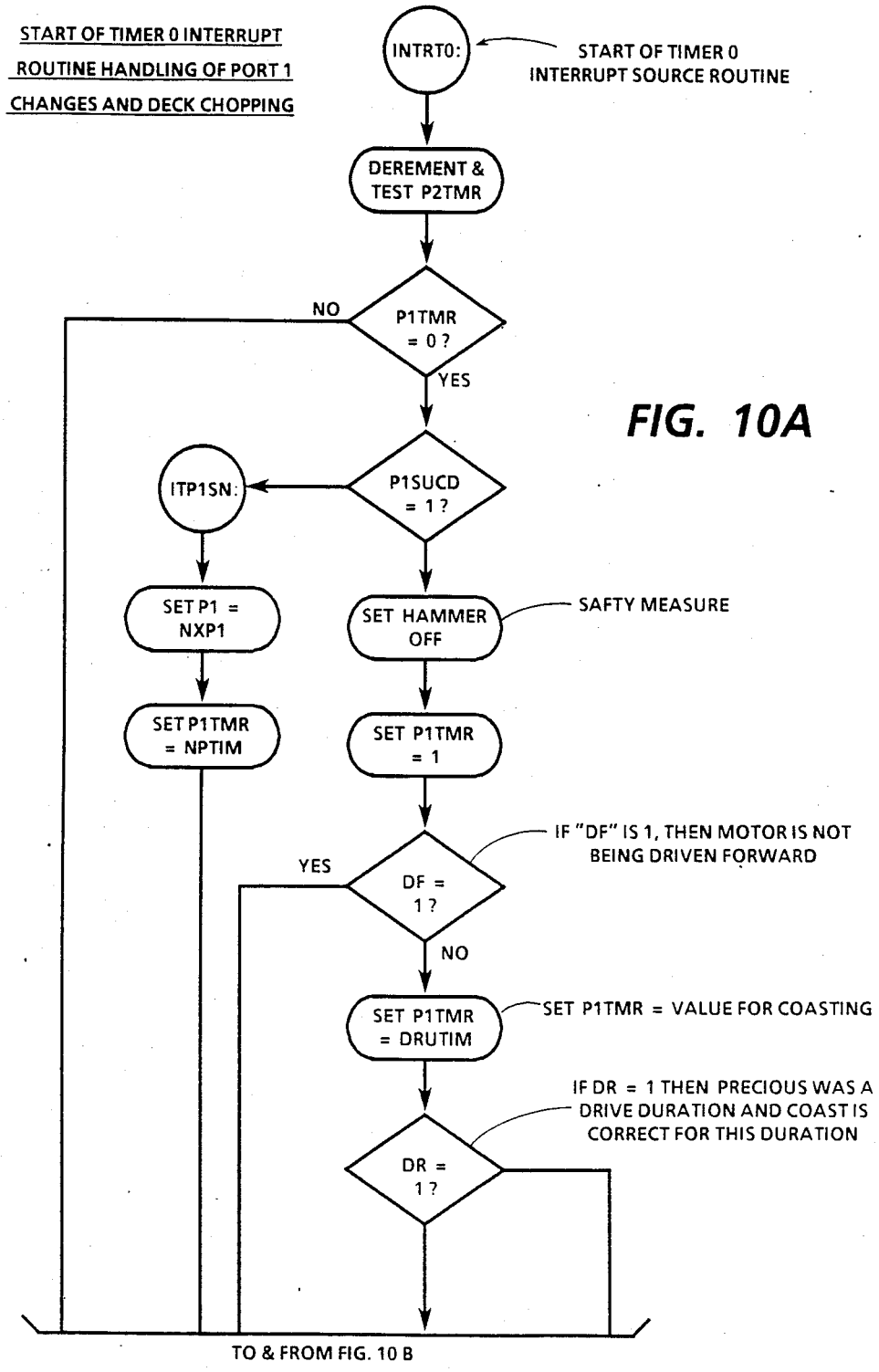
Figure 10B:
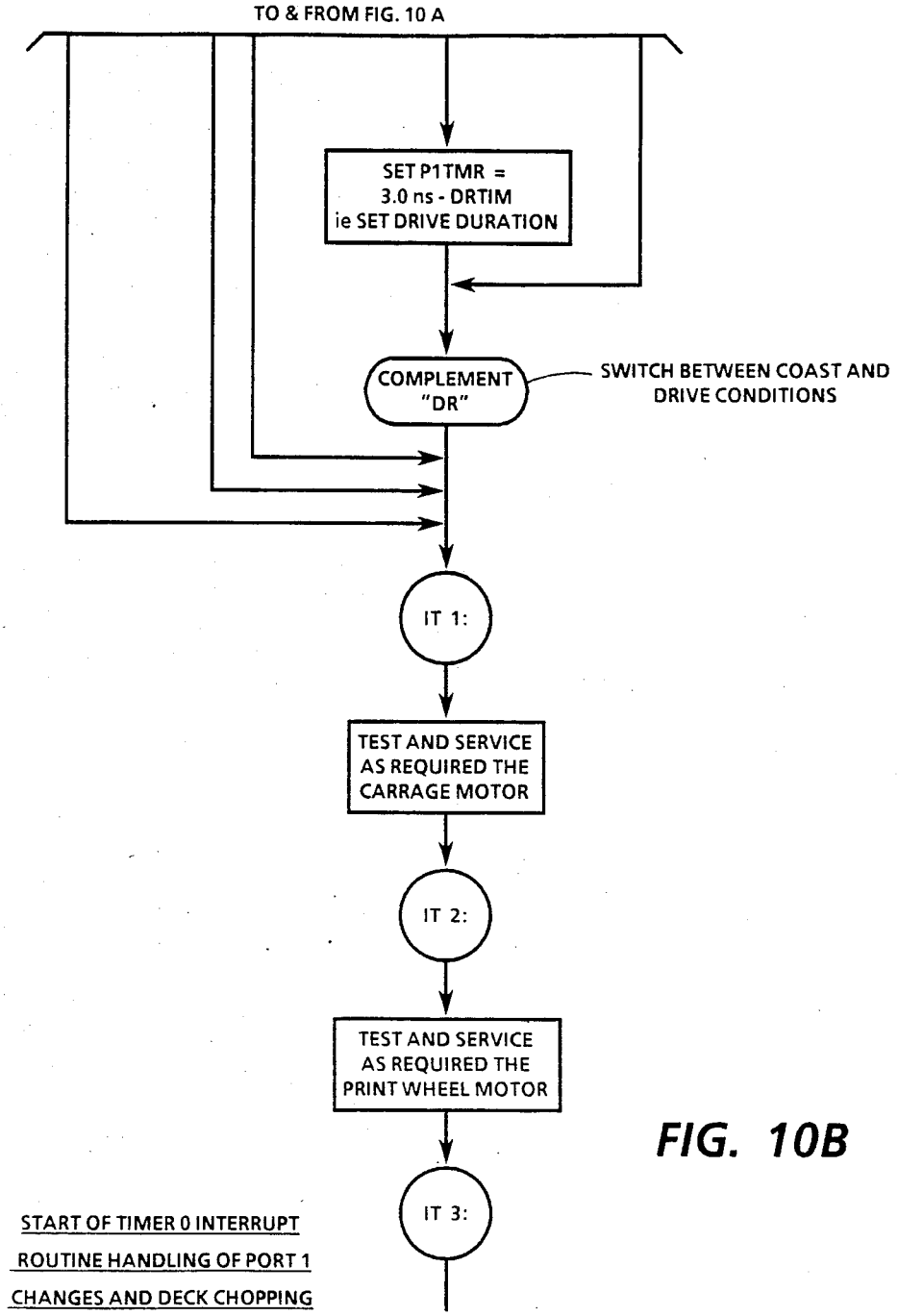

TIMER INTERRUPT ROUTINE: (FIGS. 9 and 10)

The timer interrupt routine is the heart of all timing control of the typewriter. Basically it performs the changing of the I/O pin states at the precise times required by the use of timing registers which are decremented every 0.1 milliseconds. When these registers reach zero the next I/O event is set on the processor pins and the timing registers are reloaded with the desired duration for the next event.

Since there are many times where a particular I/O function is idle flags (such as P1SVCD) or used to indicate no new event is ready to occur and the timing register should be reset to 1. By resetting to 1 the serviced flag will be tested every 0.1 ms resulting in a very fast response once the next event and time is set up. If not reset to 1 the register would be left at zero and the next decrement instruction would leave at 255 or 25.5 ms.

START OF TIMER 0 INTERRUPT ROUTINE - PORT 1 SERVICING AND DECK CHOP (FIG. 9)

As described above P1TMR is decremented and tested for zero. If no zero after decrementing the routine branches to decrement and test other registers.

If the P1TMR goes to zero the P1SVCD flag is tested to determine if a new event and time is ready for the P1 port.

If P1SVCD is set the flag is cleared in test instruction and the routine branches to set the P1TMR=NXP1 and the port condition is set to that specified by register NXP1.

If P1SVCD is not set the hammer is turned off as a safety precaution and the P1TMR is set to 1.

At this point the deck forward drive pin is tested to determine if the deck is in the forward drive mode.

IF NOT DF - i.e. not driving the deck forward the routine branches to service other timers.

IF DF - then P1TMR is set to the value in DRVTIM i.e. the coast duration.

At this point DR (reverse drive I/O pin) is tested to determine if the previous condition was a drive or coast condition.

If DR then is set the P1TMR has to be set correctly for the coast interval and the program branches to complement the DR pin i.e. set the coast state on the I/O pin.

If DR is cleared the previous duration was coast and therefore the value for P1TMR needs to be calculated i.e. P1TMR=3.0 ms−DRVTIM.

At this point the program complements the DR pin and proceeds to service the other timing functions.

DECK TIMER SECTION OF THE TIMER INTERRUPT ROUTINE: (FIG. 10)

This section of the timer interrupt routine primarily is used for home flag detection but also serves as a watch dog timer to prevent physical damage to the motor in case of a jam in the mechanism.

The first test determines if the deck is active i.e. running.

IF DKRUN is not set the program branches to service other timing functions.

IF DKRUN is set then DKTIMR is decremented and tested for zero.

IF DKTIMR is not zero the program branches to service other functions.

IF DKTIMR is ZERO the home position of the cam is detected or a jam has occurred.

At this point the DKCOST flag is tested.

IF DKCOST IS SET:

1. the flag is clear by the test
2. DRVTIM is set to a give a 30% duty cycle on the drive
3. The DKCNTR is set to equal the number of slots to hammer fire (8)
4. The DKCHOP flag is set to indicate to the deck interrupt routine tht the next deck sensor interrupt is the first after the home flag and normal speed calculations cannot therefore be performed.
5. GOTO INCAMS IF DKCOAST IS NOT SET then the HMRBID flag is tested to determine if normal stopping routine should be performed or if a failure has occurred.

IF HMRBID IS SET THEN - see INTRB:

IF HMRBID IS CLEARED then a normal stop on the home flag will be performed as follows:

1. DKCNTR is set=1
2. a reverse drive condition is set on the I/O pins to achieve a rapid stopping.
3. The time for the reverse drive condition is calculated based on the last slot duration i.e. RPM of the motor. This calculated value is then placed into P1TMR
4. NXP1 is set to the dynamic brake condition
5. the DKRUN flag is cleared indicating the deck is being stopped
6. DKCNTR is set=0 indicating home.
7. The P1SVCD flag is set so that when NXP1 value i.e. dynamic brake state will be set when the reverse duration in P1TMR has timed out.
8. GOTO INCAMS:

INTRB:

This portion of the code is executed during a fault condition whereby DKTIMR goes to zero prior to hammer fire.

When this occurs the DKFAIL flag is tested to determine if it is the first occurrence.

IF DKFAIL NOT SET then:

1. DKFAIL is set=1
2. DRVTIM is set to produce a 30% drive duty cycle
3. DKCNTR becomes an extension of DKTIMR to allow timing out to approximately 1 second.
4. GOTO INTRB1:

INTRB1: IF DKFAIL IS SET

If DKFAIL was set DKCNTR is decremented and tested for zero. (note: since DKTIMR is not reloaded in this case this code will execute every 25.6 ms if no deck sensor interrupts occur)

IF DKCNTR does not go to zero the program will branch to service other timing routines.

IF DKCNTR goes to zero then the cycle will be aborted i.e.:

1. The dynamic brake condition will be set on the I/O pins
2. All deck control flags will be reset to the idle state
3. An error beep will be initiated to alert the operator
4. The program will then go on to service other timing events

INCAMS:

This portion of the timer interrupt routine is entered each time home is detected whether coasting through home or stopping on home.

Its purpose is to detect and flag the position of the erase cam.

This is simply a matter of testing if the sensor input pin is high or low at the home position and setting the ERSCAM flag accordingly.

What is claimed is:

1. Apparatus for controlling the erase and print ribbons of a typewriter comprising:

a dc motor, a shaft driven by said motor, an erase ribbon lift cam mounted on said shaft, a print ribbon lift cam mounted on said shaft, an optical sensor, a disk mounted on said shaft comprising marks optically detectable by said sensor, said marks comprising a relatively long mark at a first point on said disk, and the remainder of the disk having relatively short marks evenly spaced around the disk except for a relatively long gap between marks at a second point opposite said long mark, one of said first and second points corresponding to the shaft position when the print and erase ribbons are in position to be struck, and the other corresponding to the shaft position when the erase ribbon only is in position to be struck, and means responsive to the output of said sensor for calculating the rate of shaft rotation by measuring the time between the detection of said short marks, and means for detecting that the position is at said first point by detecting said long mark, and at said second point by detecting said long gap.

2. The apparatus of claim 1 wherein said optical sensor comprises a light source located on one side of the disk and a light sensor located on the other side thereof, and wherein said optically detectable marks are slots in said disk.

* * * * *